United States Patent [19]

Meihofer

[11] 4,015,794

[45] Apr. 5, 1977

[54] WEB TENSION CONTROL SYSTEM

[75] Inventor: Edward F. Meihofer, Norfolk, Mass.

[73] Assignee: Butler Automatic, Inc., Canton, Mass.

[22] Filed: Sept. 15, 1975

[21] Appl. No.: 613,312

[52] U.S. Cl. ..... 242/75.44

[51] Int. Cl.[2] ..... B65H 25/22

[58] Field of Search ..... 242/75.44, 75.51, 75.52, 242/75.53, 183, 184, 189, 190; 318/6, 7

[56] References Cited

UNITED STATES PATENTS

| | | | |
|---|---|---|---|
| 3,283,228 | 11/1966 | Asseo | 242/75.51 X |
| 3,416,058 | 12/1968 | Hill et al. | 318/6 X |
| 3,497,154 | 2/1970 | Lasarev et al. | 242/75.44 |
| 3,713,009 | 1/1973 | Poppinger et al. | 242/75.51 X |

*Primary Examiner*—Stanley N. Gilreath
*Assistant Examiner*—John M. Jillions
*Attorney, Agent, or Firm*—Cesari and McKenna

[57] ABSTRACT

In a web tension control system in which web drawn from a variably braked roll passes through a festoon, a selected amount of web is maintained in the festoon by variably braking the roll. The system maintains accurate control of the festoon dancer position over a wide range of web tensions and roll diameters by means of a separate control loop whose output is a relatively slowly changing voltage proportional to the average deviation of the festoon dancer from its selected reference position.

12 Claims, 1 Drawing Figure

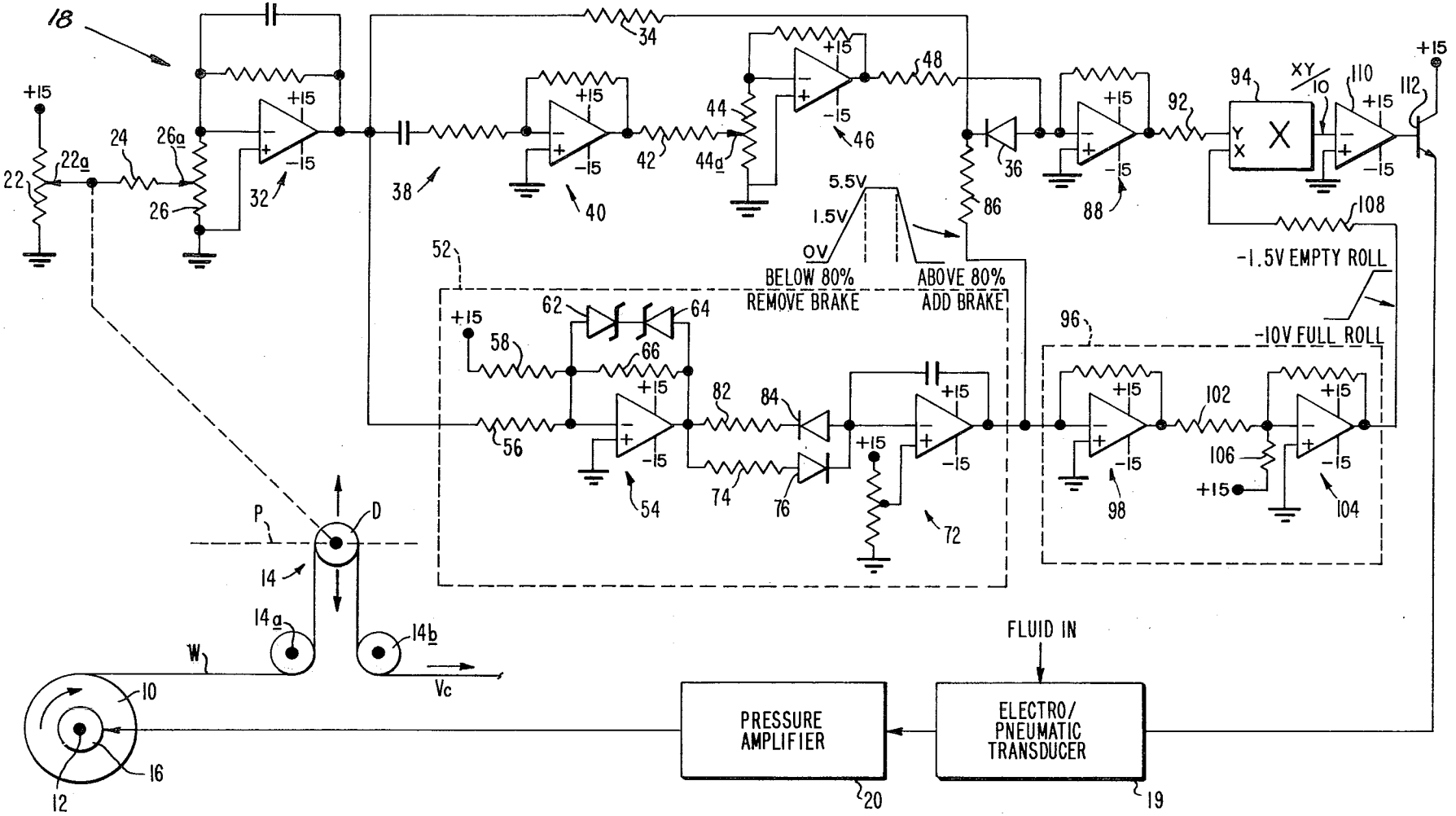
-1.5V EMPTY ROLL
-10V FULL ROLL
ABOVE 80%
ADD BRAKE
BELOW 80%
REMOVE BRAKE
5.5V
1.5V
0V
FLUID IN
ELECTRO/
PNEUMATIC
TRANSDUCER
PRESSURE
AMPLIFIER
XY/10
+15
-15
Vc
W
P
D

WEB TENSION CONTROL SYSTEM

BACKGROUND OF THE INVENTION

This invention relates to a web tension control system. It relates more particularly to a system of this type which can maintain a web festoon dancer at a selected reference position over a wide range of operating conditions.

Tension control systems are used in conjunction with splicers, unwinders, rewinders and the like to maintain substantially uniform tension in the web. In the case of an unwinder, web drawn from a roll passes through a web storage festoon which normally stores a selected quantity of web and thence to a web-consuming machine such as a printing press that draws web at a constant speed from the festoon. The festoon includes a preloaded dancer that imparts a selected tension to the web drawn from the roll, and that tension is maintained substantially constant by using the dancer position to control the braking torque applied to the unwinding web roll.

If the web tension becomes higher than the desired value, the dancer is moved in one direction from its reference position, with the result that braking torque applied to the roll decreases. Thereupon the roll unwinds at a faster rate, thereby decreasing the tension in the web so that the dancer tends to return to its reference position. On the other hand, if web tension falls below the desired value, the dancer moves in the opposite direction so that the braking torque applied to the roll is caused to increase. Accordingly, the tension in the web is increased and the dancer is returned to its reference position.

A rewinder operates in more or less the same way except that the festoon is located upstream from the roll of web being rewound and the roll is positively driven by a variable torque motor in accordance with dancer position. Since the two applications are similar, we will describe the present system only in conjunction with an unwinder.

Typically, the festoon dancer position is monitored by coupling the dancer to a potentiometer that varies a voltage in accordance with the dancer position. That voltage is compared with a fixed voltage corresponding to a selected dancer reference position to develop a dancer position error signal. The error signal is then applied to a low gain position amplifier whose output controls a transducer. That element, in turn, varies the pressure applied to a hydraulic brake associated with the unwinding web roll as needed to maintain the dancer at the selected reference position.

Conventional systems also vary braking torque in accordance with the velocity of the festoon dancer toward or away from its reference position. In addition, some prior systems vary the gain of the control system according to the size of the web roll. The instantaneous radius of the roll is monitored by a follower arm, photodetector, or, through the use of tachometers to compare the speed of the unwinding roll with that of a fixed diameter guide roller. An example of a prior system with all of these features is shown in U.S. Pat. No. 3,822,838.

In order to provide a consistent amount of festoon storage at the moment a splice cycle is initiated, the tension control system should be arranged to position the festoon dancer at a reference position representing a selected percentage of the maximum storage capacity of the festoon. That percentage should be quite high so that the festoon assuredly stores enough web to satisfy the needs of the downstream web-consuming machine as the expiring web roll is braked to a stop, spliced to the leading end of the new roll and the new roll accelerated up to line speed. Yet the percentage should not be so high that the festoon cannot accommodate normal web tension upsets encountered during the splice sequence that cause the dancer to move further toward its maximum storage position. Desirably, the festoon dancer is referenced to a position corresponding to 80% of its maximum storage position to assure an adequate web supply during splicing, particularly at high web speed. Moreover, that position should be maintained to an accuracy of the order of ±5% for all steady state operating conditions of the system.

It has been found that in order to maintain the dancer at its reference position with the desired accuracy, the tension control system must have a relatively high gain. However, it has been further found that high gain systems are quite difficult to stabilize, especially if they rely on slow response devices to brake the web roll such as the pneumatic transducers and hydraulic brakes that are prevalent in the industry.

Further, conventional web tension control systems have not been able to operate reliably to provide the wide range of braking torques required for different tension levels encountered in different web handling applications.

SUMMARY OF THE INVENTION

Accordingly, this invention aims to provide a web tension control system that maintains a festoon dancer at a selected reference position over a wide range of web tensions.

Another object of the system is to provide a system of this type which is quite stable even though it employs slow-response components to brake the web roll.

Yet another object of the invention is to provide a web tension control system which maintains the dancer at the proper reference position, despite non-linearities in the web roll brakes.

Other objects will in part be obvious and will in part appear hereinafter.

The invention accordingly comprises the features of construction, combination of elements, and arrangement of parts which will be exemplified in the following detailed description, and the scope of the invention will be indicated in the accompanying claims.

In general, to stabilize the operation of apparatus of this type, an integrating reset amplifier is employed in the tension control system to compare the average position of the festoon dancer to the selected reference position representing 80% of maximum storage. This amplifier constitutes a separate control loop in the system and its output is a relatively slowly changing voltage that is proportional to the average deviation of the dancer from the reference position.

Any time the low gain position amplifier output results in a dancer position other than the reference position, the reset amplifier recalibrates the operating range for the position amplifier to return the dancer position to the reference position. The reset amplifier thus in effect moves the position amplifier operating band.

The system also incorporates a standard dancer velocity amplifier to maintain the dancer at the desired reference position despite short-term disturbances caused by a speed change in the web-consuming machine, a variable unwinding roll condition or the like. The output of the velocity amplifier is summed along with the outputs of the position and reset amplifiers and the composite signal is used to control the pneumatic transducer that, in turn, controls the web roll brake.

To further stabilize the present control system, the system gain is varied as the braking torque requirements change. For this, the reset amplifier output is subtracted from a fixed voltage, thereby providing a signal which is proportional to the average braking torque needed to maintain the dancer at its reference position. That signal is then applied to a multiplier whose other input is the sum of the position, reset and velocity amplifier outputs. The output of the multiplier is finally applied to the pressure transducer that controls the web roll brake. Thus, as the average braking torque decreases for any reason, such as a decreasing roll diameter, a lower web setting, or a high residual torque brake, the electrical gain of the overall system is maintained essentially constant. The effect, then, is to trim the required pressure applied to the brake around the actual operating point rather than trying to span the entire pneumatic transducer range from minimum to maximum pressures that may be required for different web handling applications or running conditions.

BRIEF DESCRIPTION OF THE DRAWING

For a fuller understanding of the nature and objects of the invention, reference should be had to the following detailed description taken in connection with the accompanying drawing which is a schematic diagram of a web tension control system embodying the principles of this invention.

DESCRIPTION OF THE PREFERRED EMBODIMENT

Referring now to the drawing FIGURE, a roll 10 of Web W is supported by a spindle 12. The web W is drawn from the roll, passes through a festoon shown generally at 14 and, thence, to a web-consuming machine (not shown) that draws web from the festoon at a constant speed $V_c$.

For ease of illustration, the festoon 14 is shown as comprising simply a pair of fixed idler rollers 14*a* and 14*b* and a dancer roller D which moves vertically relative to the idler rollers. In actuality, the festoon may comprise many sets of idler rollers and dancer rollers so that many web bights are in the festoon. The dancer D is preloaded by means not shown toward its maximum storage position, i.e., upwards in this figure, and the spindle 12 is equipped with a hydraulic brake 16 which applies a drag torque to the spindle so that the web W is maintained at a selected tension as it travels to the web-consuming machine.

The tension in the web is maintained substantially constant by controlling the braking torque applied by brake 16 to spindle 12 in accordance with the position of the dancer D. More particularly, a reference position P is selected for the dancer which represents, say, 80% of the maximum storage capacity of festoon 14. If the dancer D falls below the reference position, indicating an increase in the tension in web W, a tension control system shown generally at 18 responsive to dancer position develops an output which is applied to an electro-pneumatic transducer 19. The fluid pressure is thereupon amplified by a hydraulic pressure amplifier 20 applied to brake 16 causing the brake to ease up on spindle 12. Resultantly web W enters the festoon 14 at a faster rate so that web tension becomes less allowing the preloaded dancer D to return toward its reference position P.

On the other hand, if dancer D rises above the reference position, indicating a decrease in web tension, this is sensed by system 18 which thereupon, via transducer 19 and amplifier 20, causes brake 16 to exert a greater drag on spindle 12, with the result that web tension increases so that the dancer D is drawn downward toward reference position P.

As will be seen, even though the brake 16 may have a relatively slow response, the control system is able to maintain the dancer D at its reference position with a high degree of accuracy, typically on the order of ±5%. Furthermore, the system remains quite stable over a wide range of web tensions and over a wide range of web roll diameters.

Control system 18 includes a potentiometer 22 whose contact arm 22*a* is mechanically linked to the dancer D which picks off a voltage representative of dancer position. That voltage is applied via a resistor 24 to the center tap 26*a* of a calibration potentiometer 26. The potentiometer 26 resistor is connected across the input terminals of an inverting dancer position amplifier 32. As the dancer D moves upwards toward it position of maximum storage, the output of amplifier 32 becomes more negative. Conversely, as the dancer moves downward, the amplifier 32 output becomes more positive. The potentiometer 26 is set so that when the dancer D is located at its reference position P, the output of amplifier 32 is zero volts.

The output of amplifier 32 is applied via a resistor 34 to the cathode of a diode 36. The amplifier 32 output is also coupled to differentiating circuit 38 including an inverting velocity amplifier 40 whose output represents the instantaneous velocity of the dancer D. That velocity signal is applied via a resistor 42 to the contact arm 44*a* of a velocity calibration potentiometer 44 connected between ground and the inverting input terminal of an amplifier 46. The output of amplifier 46 is then coupled via a resistor 48 to the anode of diode 36.

The voltage proportional to dancer position appearing at the output of amplifier 32 is applied to an integrating reset amplifier section indicated generally at 52, which constitutes a separate control loop in the overall system. More particularly, it is applied to the inverting input terminal of an amplifier 54 by way of a resistor 56. This voltage is summed at that point with a fixed voltage developed by a resistor 58 connected between that input terminal and a source of positive voltage.

Also, a pair of back-to-back Zener diodes 62 and 64 are connected in parallel with the amplifier feedback resistor 66. The fixed voltage at the input of amplifier 54 establishes the reference position P for the dancer D which in this case represents 80% of its maximum storage position.

When the dancer is at its reference position, the net voltage applied to amplifier 54 is essentially zero volts and its output is also zero volts. When the dancer D rises above its reference position (which occurs when there is a decrease in web tension), the output of amplifier 54 latches at a selected positive voltage due to the presence of the diodes. On the other hand, if the dancer D drops below its reference position P (signifying an increase in web tension), the positive input to amplifier 54 results in its output latching at a selected negative voltage.

The voltage at the output of amplifier 54 is coupled to the inverting input terminal of an integrator 72 along one or two paralllel paths depending upon the polarity of that voltage. If the dancer is above its reference position, the resultant positive output from amplifier 54 is applied to the integrator by way of a resistor 74 and a diode 76. On the other hand, should the dancer drop below its reference position, so that a negative voltage appears at the amplifier 54 output, conduction is by way of a resistor 82 and an appropriately connected diode 84. Thus, the output of integrator 72 is a downward ramp voltage if the dancer is above its reference position and an upward ramp voltage if the dancer is below that position.

Furthermore, the values of resistors 74 and 82 are selected so that integrator 72 integrates at a faster rate when the dancer is above position P. This is because the usual hydraulic brake 16 is a one-way brake that must be driven positively to apply additional braking torque to the spindle 12, but is just allowed to relax when less braking torque is required. Thus the steep downward ramp from integrator 72 causes the brake 16 to respond more quickly to an increased torque demand when the dancer is too high.

The output of integrator 72 which is also the output of section 52 as a whole, is applied via a resistor 86 to the to the cathode of diode 36. Thus the output of the dancer position, dancer velocity and reset amplifiers are all summed at the inverting input of an amplifier 88 and the resultant amplifier output is applied via a resistor 92 to one input of a multiplier 94.

The diode 36 is included so that a strong negative output from the dancer velocity control loop, indicating that the dancer is moving rapidly beyond its 80% storage position, overrides the contributions to the summing amplifier 88 from the dancer position amplifier 32 and the integrating reset amplifier section 52.

The other input to multiplier 94 is a negative voltage from a brake torque signal section 96. Section 96 includes an amplifier 98 which receives the output of integrator 72 at its inverting input terminal. The output of amplifier 98 is then coupled by a resistor 102 to the inverting input terminal of a second amplifier 104. Summed with that voltage is a positive voltage provided via a resistor 106 connected between that input terminal and a source of positive voltage. Thus, the output from integrator 72 is effectively subtracted from a fixed voltage to provide a negative signal at the output of amplifier 104 which is proportional to the average braking torque applied by brake 16 to spindle 12. That signal is then coupled by way of a resistor 108 to the multiplier 94.

The output from multiplier 94 is a voltage proportional to the product of its two inputs (and in the illustrated embodiment that product divided by a scaling factor 10). That output is applied to the inverting input terminal of an amplifier 110 whose output is, in turn, coupled to the base of a transistor 112. The transistor collector is connected to a source of positive voltage, while its emitter is connected in series with the induction coil in transducer 19.

When the dancer D rises above its reference position P, the output of amplifier 110 becomes more positive so that transistor 112 conducts more current through transducer 19. Resultantly the pressure applied to the brake 16 increases causing increased drag on the roll spindle 12. Conversely, when the dancer D drops below its reference position, the current flow through transistor 112 and transducer 19 coil drops thereby relieving the pressure on brake 16 and thus reducing the drag on roll spindle 12.

During operation of the system, the low gain position amplifier 32 is calibrated using the entire available dancer D travel, thereby assuring a low-gain, easily stabilized system. Any time that the amplifier 32 output tends to cause the dancer 32 to assume a position that is not the reference position P, the output from section 52 essentially recalibrates the operating range for the amplifier 32 to bring the dancer position into conformance with the reference position.

Furthermore, the output of section 96 changes the gain of the system as the need for braking torque decreases for any reason such as decreasing roll size, lower tension settings, etc., to maintain essentially constant system gain. The overall effect, then, is to trim the required pressure applied to brake 16 around the actual operating point during the particular running condition, rather than attempting to span the entire brake pressure range from minimum to maximum that might be required to handle all web handling applications and running conditions.

With the present system, then, dancer position can be maintained at the desired reference position to an accuracy of at least ± 5% for all steady state operating conditions. Furthermore, this accuracy can be maintained over a wide range of brake pressures required under the given running conditions as well as over a wide range of roll sizes, and even though the system includes relatively slow response servo actuators. Accordingly, it should find wide application in connection with web handling apparatus, particularly corrugators.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features herein described.

I claim:

1. In a web-tension control system of the type having a web roll support, a brake for braking the web roll, a festoon downstream from the web roll including a dancer around which web from the roll is trained on its way to a web consuming machine and means for controlling the brake in response to dancer position so as to maintain substantially constant tension in the web, the improvement comprising A. means for establishing a selected dancer reference position, B. means for producing a position signal indicative of the actual dancer position, C. means for comparing the average position of the dancer to the selected reference position to develop a relatively slowly changing second electrical signal representing the average braking torque required to maintain the dancer at said reference position, D. means for summing said position and second signals to produce a control signal, and E. means for applying the control signal to control said brake.

2. The system defined in claim 1 wherein said comparing means include an integrator whose output is a ramp voltage having positive or negative slope depending upon whether the dancer is above or below said reference position.

3. The system defined in claim 2 wherein the comparing means include means for establishing the absolute slope of said ramp voltage to be greater when said dancer is above said reference position than when the dancer is below said position.

4. The system defined in claim 1 and further including means responsive to the second signal from the comparing means to vary the gain of the system in accordance with the braking torque requirements thereof.

5. The system defined in claim 4 wherein the responsive means include

A. means for providing a fixed voltage, and

B. means for subtracting the second signal from said comparing means from said fixed voltage.

6. A web-tension control system comprising

A. a web roll support,

B. a brake for braking the web roll,

C. a festoon including a dancer around which web from said roll is trained on its way to a web consuming machine, D. means for producing a dancer reference position signal, E. means for sensing the position of the dancer and developing an electrical position signal representing the actual position of said dancer, F. means for comparing said reference position and position signals to produce an error signal, G. means responsive to the error signal for developing a substantially constant positive or negative output signal depending upon the direction of the deviation of the dancer from said reference position, H. an integrator for integrating said constant output signal to develop a ramp voltage having a positive or negative slope depending upon the polarity of said output signal, I. means for summing the integrator output and dancer position signal to provide a control signal for said brake, and J. means for applying said control signal to control said brake.

7. The system defined in claim 6 and further including

A. means for establishing a reference voltage,

B. means for subtracting said integrator output signal from said reference voltage to develop a difference signal, C. means for multiplying said difference signal and said control signal prior to application of said control signal to the brake so that the gain of the overall system remains substantially constant despite changing brake torque requirements.

8. The system defined in claim 6 wherein said developing means includes means for fixing said constant positive and negative signals at different amplitudes so that the ramp voltage from said integrator has a greater absolute slope when the dancer is positioned on the side of said reference position closest to the maximum storage position of the dancer that it has when the dancer is positioned on the opposite side of said reference position.

9. In a web-tension control system of the type having a web roll support, a brake for braking the web roll, a festoon downstream from the web roll including a dancer around which web from the roll is trained on its way to a web consuming machine and means for controlling the brake in response to dancer position so as to maintain substantially constant tension in the web, the improvement comprising A. means for producing a position signal indicative of the actual dancer position, B. means for producing a reference signal indicative of the desired dancer position, C. first comparing means for comparing said signals to produce an error signal, D. means for integrating the error signal, E. means for summing the integrated error signal and the position signal to produce a control signal, and F. means for applying the control signal to control said brake.

10. The system defined in claim 9 and further including

A. means for producing a velocity signal indicative of dancer velocity, and

B. means for summing the velocity signal with said position and integrated error signals so that it comprises the control signal.

11. The system defined in claim 9 and further including means for latching the error signal at a selected constant positive or negative value so that the integrated error signal has a constant positive or negative slope.

12. The system defined in claim 11 wherein the latching means includes means for fixing the positive value to be different in absolute terms from the negative value so that the slopes of the positive and negative integrated error signals are also different in absolute terms.

* * * * *